US006142764A

United States Patent [19]

Anderson et al.

[11] Patent Number: 6,142,764

[45] Date of Patent: Nov. 7, 2000

[54] METHOD FOR CHANGING THE LENGTH OF A COHERENT JET

[75] Inventors: John Erling Anderson, Somers; Balu Sarma, Airmont; William John Mahoney, Stony Point, all of N.Y.

[73] Assignee: Praxair Technology, Inc., Danbury, Conn.

[21] Appl. No.: 09/388,489

[22] Filed: Sep. 2, 1999

[51] Int. Cl.[7] ..... F23C 5/00

[52] U.S. Cl. ..... 431/8; 431/9; 431/181; 431/187

[58] Field of Search ..... 431/2, 353, 10, 431/9, 8, 158, 12, 181, 187; 239/424.5, 426

[56] References Cited

U.S. PATENT DOCUMENTS 3,427,151 2/1969 Koudelka et al. ..... 75/59
5,587,283 12/1996 Karinthi et al. ..... 431/10
5,814,125 9/1998 Anderson et al. ..... 75/414
5,823,762 10/1998 Anderson et al. ..... 431/8

FOREIGN PATENT DOCUMENTS 866139 9/1998 European Pat. Off. .

OTHER PUBLICATIONS

Stoecker et al., "Fundamental Concepts of Oxygen Cutting", Welding Research Supplement (1957) pp. 151s–156s.

*Primary Examiner*—James C. Yeung
*Attorney, Agent, or Firm*—Stanley Ktorides

[57] ABSTRACT

A method for changing the length of a coherent jet by establishing a coherent jet using a flame envelope generated using gaseous fuel and changing the flowrate of the gaseous fuel, preferably using inert gas for make up to maintain a constant total flowrate of fuel and inert gas.

10 Claims, 4 Drawing Sheets

METHOD FOR CHANGING THE LENGTH OF A COHERENT JET

TECHNICAL FIELD

This invention relates generally to coherent jet technology.

BACKGROUND ART

A recent significant advancement in the field of gas dynamics is the development of coherent jet technology which produces a laser-like jet of gas which can travel a long distance while still retaining substantially all of its initial velocity and with very little increase to its jet diameter. One very important commercial use of coherent jet technology is for the introduction of gas into liquid, such as molten metal, whereby the gas injector may be spaced a large distance from the surface of the liquid, enabling safer operation as well as more efficient operation because much more of the gas penetrates into the liquid than is possible with conventional practice where much of the gas deflects off the surface of the liquid and does not enter the liquid.

In some circumstances it is desirable to change the length of the coherent jet, such as its length from the gas injector to the liquid surface. This can be done by changing the elevation of the gas injector, i.e. bringing it closer to or farther from the surface of the liquid, but this is cumbersome and time consuming. It is also possible to change the length of the coherent jet by changing the dimensions of the gas injector nozzle but, again, this is inconvenient. Furthermore, it is possible to change the length of the coherent jet by changing the flowrate of the gas which comprises the coherent jet. However, such practice may be undesirable because it can potentially adversely affect the overall process, e.g. metal refining, wherein the coherent jet technology is being employed.

Accordingly it is an object of this invention to provide a method for changing the length of a coherent jet without the need for changing the equipment used to produce the coherent: jet, and also without the need for changing any other aspect, such as the flowrate, of the gas making up the coherent jet.

SUMMARY OF THE INVENTION

The above and other objects, which will become apparent to those skilled in the art upon a reading of this disclosure, are attained by the present invention which is:

A method for changing the length of a coherent jet comprising:

(A) providing main gas in a main gas stream at a main gas flowrate, providing gaseous fuel at a first gaseous fuel flowrate, and combusting gaseous fuel with oxidant to form a flame envelope coaxial with the main gas stream to establish a coherent jet having a first length; and thereafter (B) providing main gas in a main gas stream at a main gas flowrate, providing gaseous fuel at a second gaseous fuel flowrate which differs from the first gaseous fuel flowrate, and combusting gaseous fuel with oxidant to form a flame envelope coaxial with the main gas stream to establish a coherent let having a second length which differs from the first length.

As used herein the term "coherent jet" means a gas jet which has a velocity profile for a considerable distance downstream of the nozzle from which it was ejected which is similar to the velocity profile which it has upon ejection from the nozzle.

As used herein the term "annular" means in the form of a ring.

As used herein the term "flame envelope" means an annular combusting stream coaxial with the main gas stream.

As used herein the term "length" when referring to a coherent gas jet means the distance from the nozzle from which the gas is ejected to the intended impact point of the coherent gas jet or to where the gas jet ceases to be coherent.

DETAILED DESCRIPTION

The invention will be described in detail with reference to the Drawings.

Figure 1:
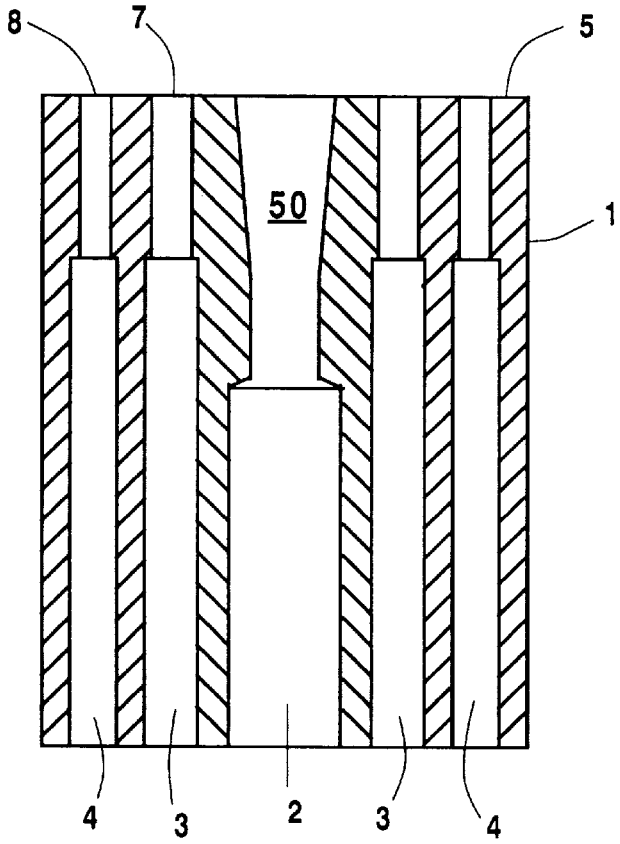
FIG. 1 is a cross sectional view and FIG. 2 is a head on view of one embodiment of a lance tip which may be used as an injector for gas in the practice of this invention.
Figure 2:
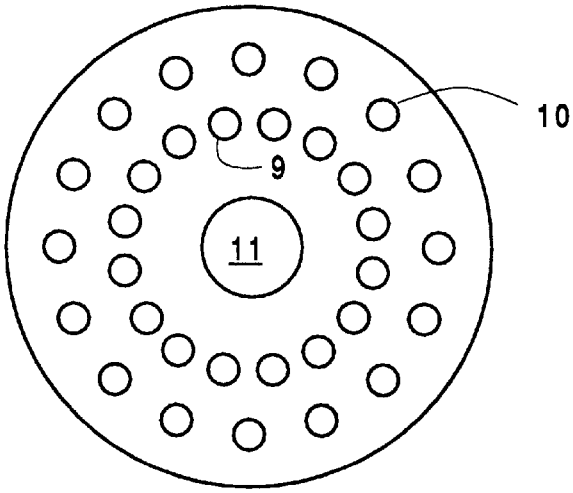

Referring now to FIGS. 1 and 2, main gas is passed through central passage 2 of coherent jet lance 1, then through converging/diverging nozzle 50 and then out from lance 1 through nozzle opening 11 to form a main gas stream. Typically the velocity of the main gas stream is within the range of from 1000 to 8000 feet per second (fps,), and the flowrate of the main gas stream is within the range of from 10,000 to 2,000,000 cubic feet per hour (CFH).

Any effective gas may be used as the main gas in the practice of this invention. Among such gases one can name oxygen, nitrogen, argon, carbon dioxide, hydrogen, helium, steam and hydrocarbon gases. Also mixtures comprising two or more gases, e.g. air, may be used as the main gas in the practice of this invention. A particularly useful gas for use as the main gas in the practice of this invention is gaseous oxygen which may be defined as a fluid having an oxygen concentration of at least 25 mole percent. The gaseous oxygen may have an oxygen concentration exceeding 90 mole percent and may be commercial oxygen which is essentially pure oxygen.

Gaseous fuel, such as methane, natural gas or atomized liquid, e.g. atomized fuel oil, is provided through lance 1 in either passage 3 or passage 4, each of which is radially spaced from and coaxial to central passage 2. Preferably the gaseous fuel is provided by passage through the more inner coaxial passage 3. The gaseous fuel passes out from lance 1 through either nozzle 7 or 8 preferably, as shown in FIG. 1, at the lance face 5 flush with the opening of nozzle 50. The opening of nozzles 7 and 8 could each be an annular opening around opening 11 or preferably, as shown in FIG. 2, are each a ring of holes 9 and 10 around nozzle opening 11. The gaseous fuel is provided out from lance 1 at a velocity which is preferably less than the velocity of the main gas and generally within the range of from 100 to 1000 fps.

The gaseous fuel combusts with oxidant to form a flame envelope around and along the main gas stream, preferably for the entire length of the coherent jet. The oxidant may be air, oxygen-enriched air having an oxygen concentration exceeding that of air, or commercial oxygen having an oxygen concentration of at least 99 mole percent. Preferably the oxidant is a fluid having an oxygen concentration of at least 25 mole percent. The oxidant may be provided for combustion with the gaseous fuel in any effective manner. One preferred arrangement, which is illustrated in FIGS. 1 and 2, involves providing the oxidant through the coaxial passage, either passage 3 or passage 4, which is not used for the provision of gaseous fuel. This results in the gaseous fuel and the oxidant interacting and combusting to form the flame envelope upon their respective ejections out from lance 1.

The flame envelope around the main gas stream serves to keep ambient gas from being drawn into the main gas stream, thereby keeping the velocity of the main gas stream from significantly decreasing and keeping the diameter of the main gas stream from significantly increasing, for the desired length of the main gas stream until the main gas stream reaches the desired impact point, such as the surface of a pool of molten metal. That is, the flame envelope serves to establish and maintain the main gas stream as a coherent jet for the length of the jet.

The invention enables one to change the length of the coherent jet without the need to make any equipment changes, such as changing the main gas nozzle or changing the distance between the lance tip and the desired impact point., and also without the need to change the main gas flowrate. In the practice of this invention when one desires to change the length of the coherent jet from the existing length, i.e. the first length, to another length, i.e. the second length, all that is necessary is to change the flowrate of the gaseous fuel from that used to produce the flame envelope associated with the first length, i.e. the first gaseous fuel flowrate, to a second gaseous fuel flowrate. An increase in the gaseous fuel flowrate from the first to the second gaseous fuel flowrate will increase the length of the coherent jet from the first length to the second length, and a decrease in the gaseous fuel flowrate from the first to the second gaseous fuel flowrate will decrease the length of the coherent jet from the first length to the second length.

Figure 3:
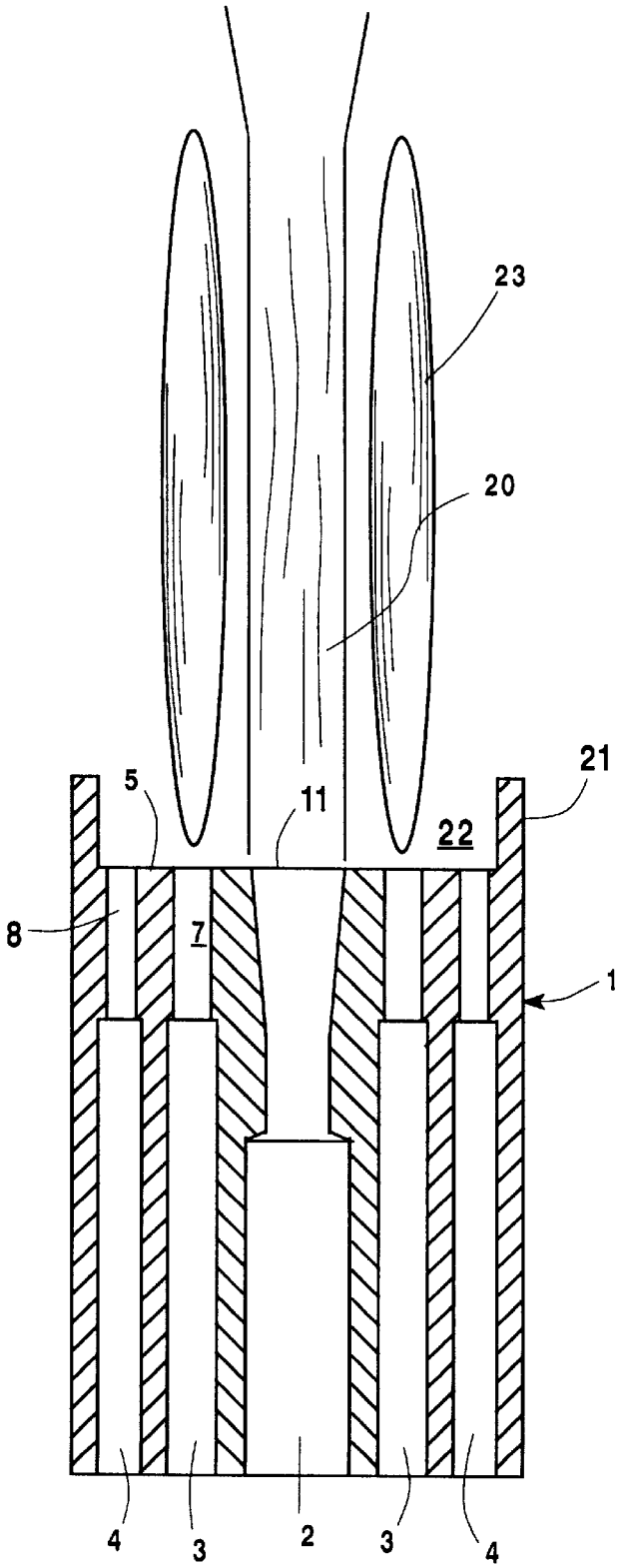
FIGS. 3 and 4 illustrate the operation of the invention whereby the coherent jet length is changed. The numerals in the Figures are the same for the common elements.
Figure 4:
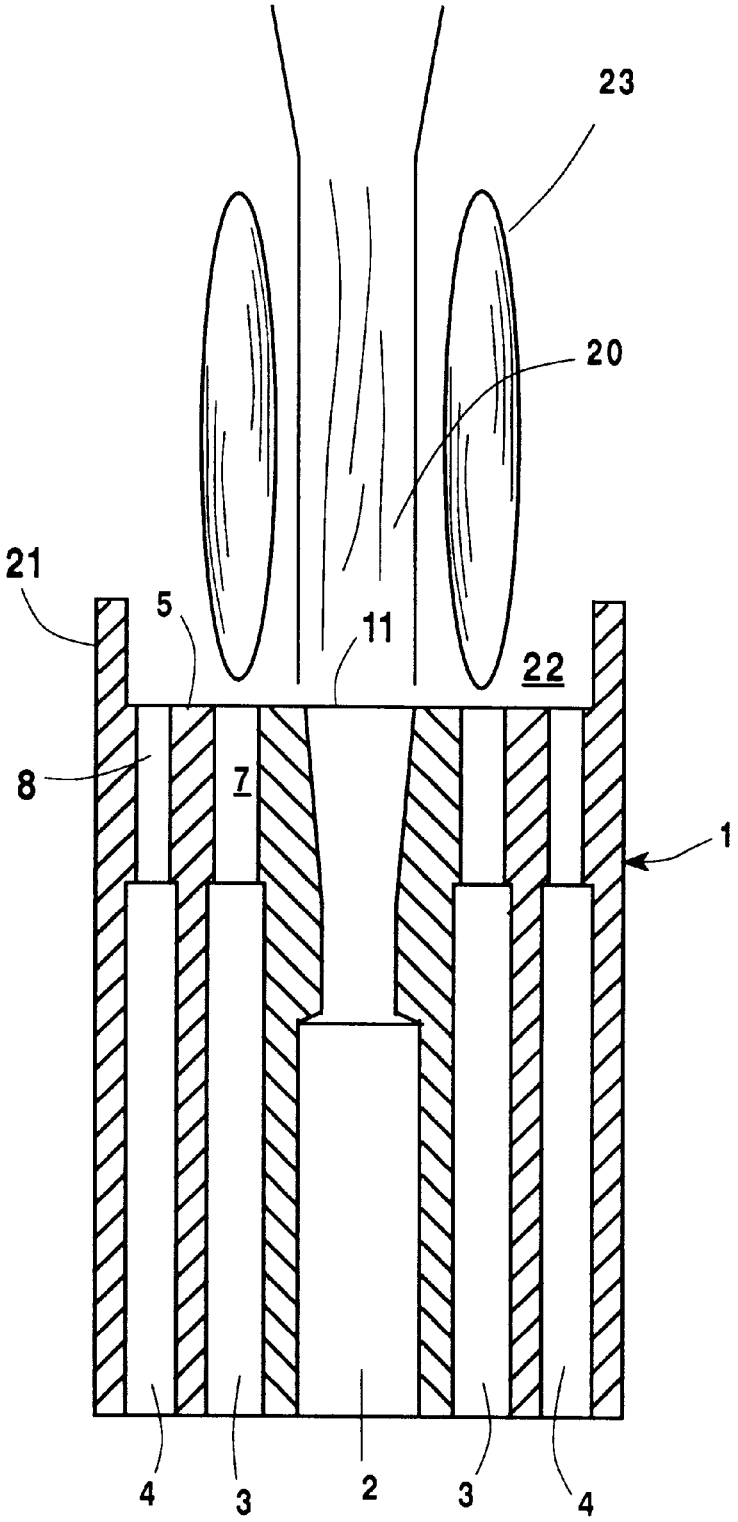

FIGS. 3 and 4 illustrate the operation of the invention wherein the coherent jet 20 has a first length, shown in FIG. 3, which exceeds its second length, shown in FIG. 4. Generally the length of the coherent jet is approximately proportional to the square root of the gaseous fuel flowrate. FIGS. 3 and 4 also illustrate a particularly preferred embodiment wherein an extension is used to assist in the formation of the flame envelope. Extension 21, having a length generally within the range of from 0.5 to 6 inches, extends from lance end face 5 forming a volume 22 with which nozzle output opening 11 and annular ejection means 7 and 8 communicate, and within which each of the gas jet and the flame envelope 23 around the main gas jet 20 initially form. Volume 22 formed by extension 21 establishes a protective zone which serves to protect the main gas stream and the fuel and oxidant immediately upon their outflow from the lance end thus helping to achieve coherency for the main gas jet. The protective zone induces recirculation of the fuel and oxidant around the main gas jet.

Figure 5:
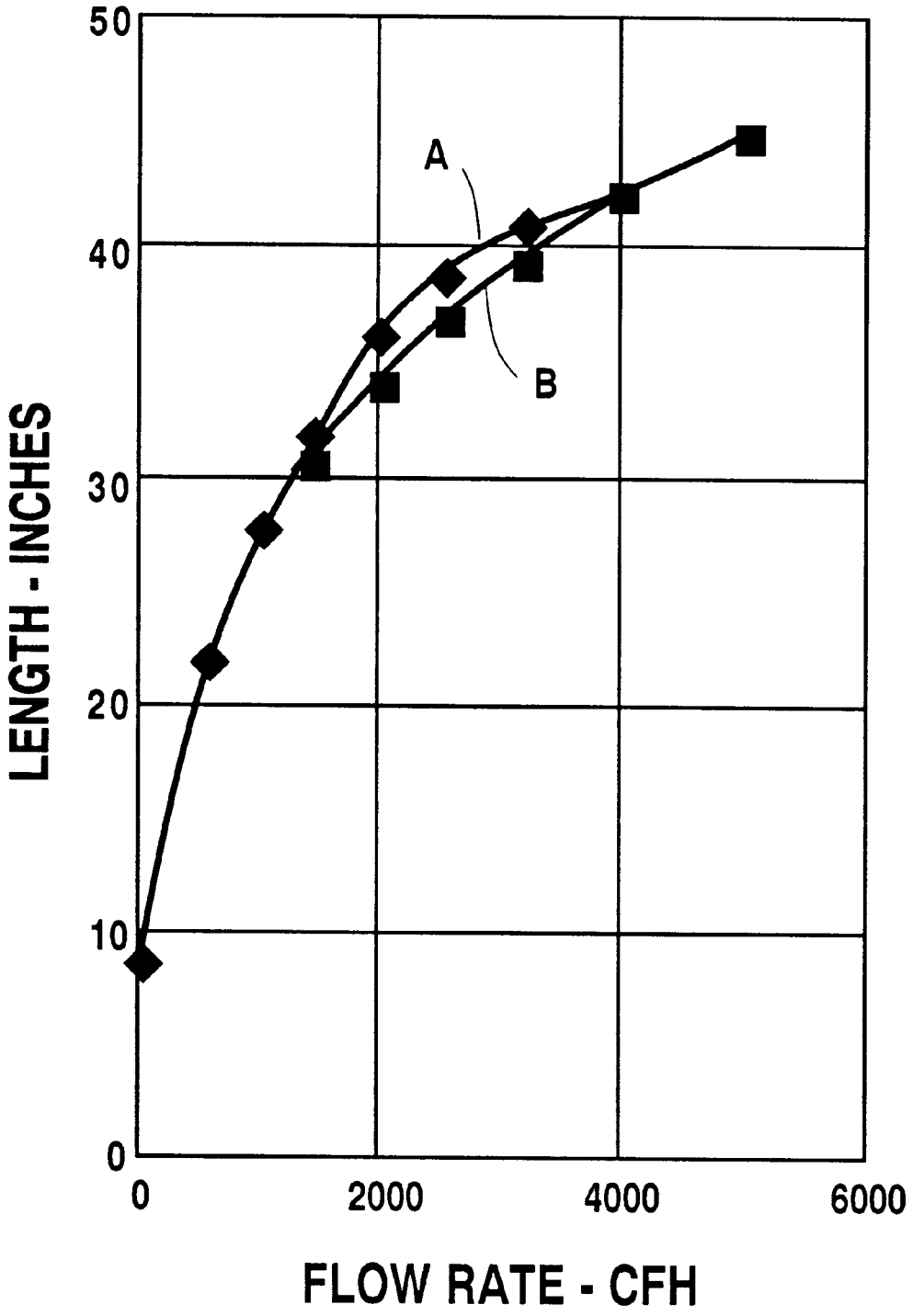
FIG. 5 is a graphical representation of experimental results demonstrating the operation of the invention.

The following test results are presented to exemplify and further illustrate the invention. They are not intended to be limiting. In these examples a lance similar to that illustrated in FIGS. 3 and 4 was used to establish the coherent jets. The nozzle for the main gas was a converging/diverging nozzle with a throat diameter of 0.62 inch and an exit diameter of 0.81 inch. The main gas was commercial oxygen and was ejected from the lance at a flowrate of 36,000 cubic feet per hour (CFH) at a supply pressure of 100 pounds per square inch gauge (psig). The gaseous fuel was natural gas delivered through the more inner passage and ejected from the lance through 16 holes, each having a diameter of 0.154 inch on a 2 inch diameter circle on the lance face. The oxidant which combusts with the gaseous fuel to form the flame envelope was commercial oxygen and was delivered through the more outer passage and elected from the lance through 16 holes, each having a diameter of 0.199 inch on a 2.75 inch diameter on the lance face. The flowrate of this oxygen was kept constant during the tests as the flowrate of the gaseous fuel was changed. The lance also had a 2 inch long extension at it periphery to shield the gases upon their ejection from the lance. The coherent jet had a supersonic velocity of about 1600 feet per second The length of the coherent jet established by the above-described parameters was measured for a given gaseous fuel flowrate and the results recorded. The gaseous fuel flowrate was then changed, i.e. to a second gaseous fuel flowrate, and the new length, i.e. the second length, of the coherent jet was measured and recorded. The results are shown in FIG. 5 as curve A. In FIG. 5 the coherent jet length is measured on the vertical axis and the gaseous fuel flowrate is measured on the horizontal axis. As can be seen from curve A, one can increase the length of the coherent jet by increasing the gaseous fuel flowrate and one can decrease the length of the coherent jet by decreasing the gaseous fuel flowrate.

In going from 0 to 5000 CFH natural gas (FIG. 5), the increase in the length of the coherent jet is initially very sharp and then becomes gradual. From 0 to 1000 CFH natural gas, the coherent jet length increases from 9 to 28 inches, an increase of 19 inches (more than 200%). With an additional increase of 4000 CFH natural gas (going from 1000 to 5000 CFH natural gas), the coherent jet length increases from 28 to 46 inches, an increase of 18 inches (about 65% more).

FIG. 5 also shows the results obtained with a preferred embodiment of the invention which also serves to illustrate the unexpected nature of the invention. The procedure described above was repeated except that when the gaseous fuel flowrate was reduced so as to be less than 5000 CFH, and inert gas, which in this example was nitrogen gas, was added to the fuel so that the total flowrate of the gaseous fuel and the inert gas equaled 5000 CFH. The results of this set of tests are shown in FIG. 5 as curve B. As can be seen, the results for the operation of the invention with the inert gas make-up are essentially the same as the results when the inert gas is not employed. This demonstrates that the control of the coherent jet length by the manipulation of the gaseous fuel flowrate is not simply a physical effect caused by the flowrate change of the fluid flowing adjacent the main gas stream because the (same control is achieved when the flowrate of the fluid flowing adjacent the main gas stream remains constant (curve B).

The results shown in curve B of FIG. 5 serve not only to demonstrate the unexpected nature of the invention but also serve to exemplify a preferred embodiment of the invention. At low flowrates of gaseous fuel, the holes through with the fuel is ejected could foul or otherwise become plugged. By using make-up inert gas with the gaseous fuel, a high total flowrate of fuel and inert gas can be maintained so as to counteract any fouling potential without, as demonstrated by the tests reported in FIG. 5, sacrificing any of the control of the coherent jet length.

Any suitable number of coherent jets may be used in the practice of this invention. When more than one coherent jet is used in an industrial application, the method of this invention may be used to change the length of one or any number, including all, of the coherent jets. For example, in a basic oxygen furnace employing four coherent jets, the gaseous fuel flowrate to all of the lances may be changed so as to simultaneously change the length of all of the coherent jets.

Now, with the use of this invention, one can quickly and accurately change the length of a coherent jet without the need to make any equipment change or the need to change the flowrate of the gas making up the coherent jet. Although the invention has been described in detail with reference to certain preferred embodiments, those skilled in the art will recognize that there are other embodiments of the invention within the spirit and the scope of claims. For example, where the gaseous fuel employed is an atomized liquid, there may also be employed a means for providing atomizing gas to the fuel.

What is claimed is:

1. A method for changing the length of a coherent jet comprising:

(A) providing main gas in a main gas stream at a main gas flowrate, providing gaseous fuel at a first gaseous fuel flowrate, and combusting gaseous fuel with oxidant to form a flame envelope coaxial with the main gas stream to establish a coherent jet having a first length; and thereafter (B) providing main gas in a main gas stream at a main gas flowrate, providing gaseous fuel at a second gaseous fuel flowrate which differs from the first gaseous fuel flowrate, and combusting gaseous fuel with oxidant to form a flame envelope coaxial with the main gas stream to establish a coherent jet having a second length which differs from the first length.

2. The method of claim 1 wherein the second gaseous fuel flowrate is greater than the first gaseous fuel flowrate and the second length is greater than the first length.

3. The method of claim 1 wherein the second gaseous fuel flowrate is less than the first gaseous fuel flowrate and the second length is less than the first length.

4. The method of claim 1 wherein the main gas is gaseous oxygen.

5. The method of claim 1 wherein inert gas is added to the gaseous fuel provided at the second gaseous fuel flowrate.

6. The method of claim 5 wherein the inert gas is nitrogen gas.

7. The method of claim 5 wherein the inert gas is provided at an inert gas flowrate such that the sum of the inert gaseous flowrate and the second gaseous fuel flowrate is substantially equal to the first gaseous fuel flowrate.

8. The method of claim 1 wherein inert gas at a first inert gas flowrate is added to the gaseous fuel provided at the first gaseous fuel flowrate, and inert gas at a second inert gas flowrate is added to the gaseous fuel provided at the second gaseous fuel flowrate.

9. The method of claim 1 wherein a plurality of coherent jets are employed and the gaseous fuel flowrate for each of said coherent jets is changed so that the length of each said coherent jet is changed.

10. The method of claim 1 wherein the oxidant for combustion with the gaseous fuel to form the flame envelope is provided at a flowrate during step (A) which is substantially the same as the flowrate at which it is provided during step (B).

* * * * *

UNITED STATES PATENT AND TRADEMARK OFFICE

CERTIFICATE OF CORRECTION

PATENT NO. : 6,142,764

DATED : November 7, 2000

INVENTOR(S) : Anderson et al.

It is certified that error appears in the above-indentified patent and that said Letters Patent is hereby corrected as shown below:

In column 1, line 61, delete "let" and insert therefor --jet--.

In column 4, line 4, delete "elected" and insert therefor --ejected--.

In column 4, line 48, between "the" and "same" delete "(".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*